US006094555A

United States Patent [19]

Katoh et al.

[11] Patent Number: 6,094,555

[45] Date of Patent: Jul. 25, 2000

[54] DEVELOPER AMOUNT REGULATING MEMBER, METHOD OF PRODUCING THE SAME, AND DEVELOPMENT DEVICE USING THE SAME

[75] Inventors: Hisao Katoh, Ooi-machi; Masahiro Watabe, Yokohama; Arihiro Yamamoto, Tokyo, all of Japan

[73] Assignee: Canon Kabushiki Kaisha, Tokyo, Japan

[21] Appl. No.: 09/238,033

[22] Filed: Jan. 27, 1999

[30] Foreign Application Priority Data

Jan. 30, 1998 [JP] Japan ..... 10-019449

[51] Int. Cl.[7] ..... G03G 15/08

[52] U.S. Cl. ..... 399/284; 399/274

[58] Field of Search ..... 399/274, 284

[56] References Cited

U.S. PATENT DOCUMENTS

| | | | |
|---|---|---|---|
| 4,842,797 | 6/1989 | Matsumura et al. | 264/203 |
| 5,171,834 | 12/1992 | Funaki | 264/233 X |
| 5,353,104 | 10/1994 | Kato et al. | 355/259 |
| 5,585,057 | 12/1996 | Trotta | 264/130 |
| 5,587,776 | 12/1996 | Watabe et al. | 399/284 |
| 5,689,783 | 11/1997 | Sasame et al. | 399/284 |
| 5,713,120 | 2/1998 | Watabe et al. | 29/527.4 |
| 5,729,806 | 3/1998 | Niwano et al. | 399/284 |
| 5,893,013 | 4/1999 | Kinoshita et al. | 399/284 |
| 5,895,150 | 4/1999 | Watabe et al. | 399/284 |

FOREIGN PATENT DOCUMENTS

| | | |
|---|---|---|
| 4-76577 | 3/1992 | Japan . |
| 6-149031 | 5/1994 | Japan . |
| 9-50185 | 2/1997 | Japan . |

*Primary Examiner*—Fred L Braun

*Attorney, Agent, or Firm*—Fitzpatrick, Cella, Harper & Scinto

[57] ABSTRACT

A developer amount regulating member includes at least a portion for regulating the amount of a developer, which is made of a polyamide elastomer. The content of a polyamide dimer in the polyamide elastomer is decreased to less than 2500 ppm, thereby suppressing blooming of the oligomer component in long-term use or an environment of high temperature and high humidity, and maintaining the good specularity of the regulating member. Therefore, it is possible to prevent the problem of fogging due to blooming, and provide a high-quality image.

11 Claims, 2 Drawing Sheets

DEVELOPER AMOUNT REGULATING MEMBER, METHOD OF PRODUCING THE SAME, AND DEVELOPMENT DEVICE USING THE SAME

BACKGROUND OF THE INVENTION

1. Field of the Invention

The present invention relates to a developer amount regulating member used for developing an electrostatic latent image formed on an image holding member to visualize the latent image. Particularly, the present invention relates to a developer amount regulating member for regulating the amount of the developer coated on the surface of a developer holding member for holding and carrying the developer to a development region to apply a charge to the developer by triboelectric charging, and a development device using the developer amount regulating member.

2. Description of the Related Art

As shown in FIG. 1, a conventional known development device comprises a developer holding member 3 (referred to as a "development sleeve" hereinafter) mounted in a development container 2 with a small space from an electrophotographic photosensitive member 1, a developer amount regulating member 4 (referred to as a "development blade" hereinafter), an elastic roller 5, and a one-component developer 6 (referred to as "toner" hereinafter). As means for regulating, to a thin layer, the thickness of a toner layer held and carried to the development unit by the development sleeve, a method is employed in which the developer amount regulating member is brought into contact with the development sleeve, and the toner is passed through the contact portion between the developer amount regulating member and the development sleeve to regulate the thickness of the toner layer, to form a thin toner layer on the development sleeve and apply a triboelectric charge for developing a latent image to the toner in the contact portion.

Examples of such a developer amount regulating member include a rubber plate, a metallic thin plate, a resin thin plate, and a lamination thereof. Particularly, for new types of toner such as low-melting-point toner (sharp melting toner) for fixing at a temperature lower than conventional temperatures from the viewpoint of energy saving, a nonmagnetic toner for forming color images, and polymerization toner, Japanese Patent Laid-Open No. 9-50185 discloses a development blade made of a polyamide elastomer which has the property of applying an appropriate triboelectric charge to a developer, and elastic properties. Therefore, the use of such a development blade causes uniform contact force between the developer holding member and the development blade and enables the developer to be held on the developer holding member with a uniform thickness and a uniform amount of triboelectric charge, thereby preventing charge-up of the developer and realizing a high image density. However, in order to effectively triboelectrically charge the toner, it is necessary that the blade surface be a mirror surface, and specularity be held by injection molding using a mold finished to a mirror surface.

However, when a polyamide elastomer is molded by injection molding to realize a blade surface having good surface accuracy by transferring the mirror surface of a mold, chargeability of the toner deteriorates in long-term storage in an environment of normal temperature and normal humidity, and a fogging phenomenon occurs in which the toner is developed in a non-image region.

This phenomenon becomes significant in long-term storage in an environment of high temperature and high humidity.

As a result of examination of the cause of this phenomenon, the cause was confirmed to be that a polyamide elastomer contains 3000 to 5000 ppm of polyamide dimer, and the polyamide dimer bleeds to the blade surface to bloom the blade surface and roughen the surface.

SUMMARY OF THE INVENTION

Accordingly, it is an object of the present invention to provide a developer amount regulating member made of a polyamide elastomer and exhibiting a good charge applying ability for a long period of time.

It is another object of the present invention to provide a method of producing such a developer amount regulating member.

It is a further object of the present invention to provide a development device using such a developer amount regulating member.

In accordance with an aspect of the present invention, there is provided a developer amount regulating member comprising at least a portion made of a polyamide elastomer, for regulating the amount of a developer, wherein the content of a polyamide dimer in the polyamide elastomer is less than 2500 ppm.

In accordance with another aspect of the present invention, there is provided a method of producing a developer amount regulating member comprising at least a portion made of a polyamide elastomer, for regulating the amount of a developer, the method comprising molding a polyamide elastomer treated with a solvent for extracting the polyamide dimer contained in the polyamide elastomer to decrease the content of the polyamide dimer to less than 2500 ppm.

In accordance with a further aspect of the present invention, there is provided a development device comprising at least a developer container for containing a developer, a developer holding member comprising a rotating member having a cylindrical surface for holding the developer contained in the container, and a developer amount regulating member brought into contact with the developer holding member to regulate the amount of the developer held by the surface, and apply a charge to the developer, wherein at least a portion of the developer amount regulating member, which regulates the amount of the developer, is made of a polyamide elastomer, and the content of a polyamide dimer in the polyamide elastomer is less than 2500 ppm.

In accordance with the present invention, by using a polyamide elastomer containing less than 2500 ppm of polyamide dimer for the developer amount regulating member, it is possible to maintain the good mirror surface of the member without deteriorating surface roughness due to blooming in an environment of normal temperature and normal humidity, and provide the developer amount regulating member which causes no surface roughness even when long-term storage in an environment of high temperature and high humidity is required. It is thus possible to maintain the function to apply charge to toner in a satisfactory state for a long period of time, and form a good image without fogging.

Further objects, features and advantages of the present invention will become apparent from the following description of the preferred embodiments with reference to the attached drawings.

DESCRIPTION OF THE PREFERRED EMBODIMENT

Figure 1:
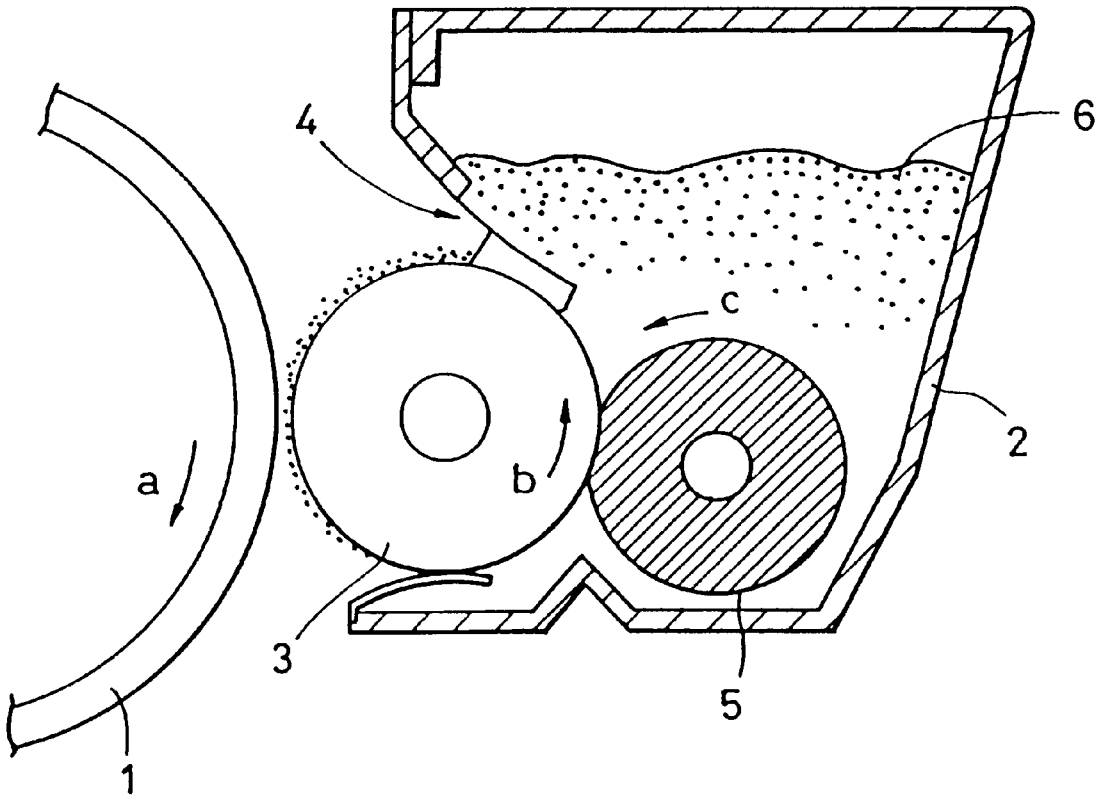
FIG. 1 PRIOR ART
FIG. 1 is a drawing illustrating an example of a development device of the present invention.
Figure 2:
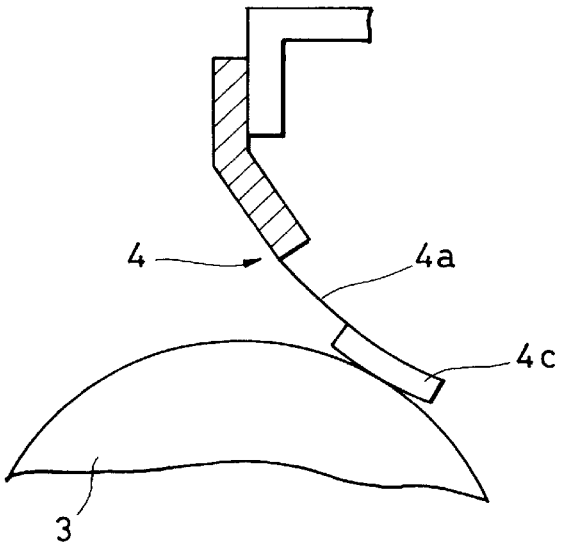
FIG. 2 is a drawing illustrating an example of a state in which a developer amount regulating development blade of the present invention is used.

FIG. 2 shows the detailed construction of the developer amount regulating development blade 4 of the present invention shown in a partial enlarged view of FIG. 1. Referring to FIG. 2, the developer amount regulating development blade 4 comprises a support layer 4*a* and a charge applying layer 4*c*. The charge applying layer 4*c* is made of a polyamide elastomer. A suitable polyamide elstomer is a block copolymer of a polyamide and a polyether. The block copolymer of a polyamide and a polyether exhibits triboelectric chargeability of the polyamide component, and elasticity of the polyether component. Therefore, the use of the block copolymer for the developer amount regulating development blade eliminates the need for coating or adding an additive for improving triboelectric chargeability, and obtain the developer amount regulating development blade having excellent productivity. Furthermore, a combination with the support layer prevents the contact pressure between the developer holding member and the developer amount regulating development blade from being decreased due to permanent deformation (permanent set in fatigue), thereby preventing an image fault due to a decrease in the contact pressure.

Examples of polyamides used for forming the block copolymer of a polyamide and a polyether include nylon 6, 6•6, 6•10, 6•12, 11, 12, and 12•12; polyamides obtained from polycondensation of different monomers of polyamides; and the like. Polyamides having terminal amino groups carboxylated by a dibasic acid or the like are preferably used, and nylon 12 is particularly suitable for polyamides.

Examples of dibasic acids which can be used include aliphatic saturated dicarboxylic acids such as oxalic acid, succinic acid, adipic acid, suberic acid, sebacic acid, dodecanic diacid, and the like; aliphatic unsaturated dicarboxylic acids such as maleic acid, and the like; aromatic dicarboxylic acids such as phthalic acid, terephthalic acid, and the like; polydicarboxylic acids synthesized from these dibasic acids and diols, such as ethylene glycol, butane diol, hexane diol, octane diol, decane diol, and the like.

Examples of the polyether component include polyether diols such as homopolymerized or copolymerized polyethylene glycol, polypropylene glycol, polytetramethylene glycol, and the like; polyether diamines having both aminated terminals; and the like. The block copolymer of a polyether and a polyamide, which has an ester bond (polyether polyester polyamide) or an amido bond (polyether polyamide), is formed by using a polyether and a carboxylated polyamide.

In order to sufficiently triboelectrically charge the developer, the content of the polyamide component in the polyamide elastomer structure is preferably 20% by weight or more. In order to realize good elasticity of the polyamide elastomer, and prevent charge-up of the developer, the content of the polyamide component is preferably 80% by weight or less.

When the development blade comprising a polyamide elastomer is allowed to stand in an atmosphere of normal temperature and normal humidity for a long time, the oligomer component blooms to the surface treated to a mirror surface, and roughen the blade surface. Particularly, in allowing the development blade to stand in an environment of high temperature and high humidity, blooming significantly occurs, and the amount of blooming increases with the passage of time to finally completely cover the surface of the blade. It has been confirmed that the blooming components are mainly composed of a polyamide dimer. By removing the oligomer component from the polyamide elastomer in a pellet state by extraction with an organic solvent so that the dimer content is less than 2500 ppm, blooming is suppressed, thereby preventing roughening of the blade surface. In order to cope with high temperature and high humidity, it is effective that the amount of dimer is less than 1000 ppm. Examples of extraction solvents include methanol, THF, chloroform, o-chlorophenol, acetone, xylene, methyl ethyl ketone, solvent mixtures thereof, and the like; methanol is most preferable because of its high safety.

As the support layer, the following materials can be used: (1) a metallic plate, for example, such as a stainless steel plate (tensile strength of about 1080 Mpa), a phosphor bronze plate (tensile strength of about 640 Mpa), an aluminum plate (tensile strength of about 390 Mpa), or the like, which preferably has a thickness of 20 to 500 $\mu$m from the viewpoint of control of contact pressure on the development sleeve; (2) a resin plate, for example, such as a polyethylene terephthalate resin plate (tensile strength of about 195 Mpa), a polycarbonate resin plate (tensile strength of about 98 Mpa), an oriented polypropylene resin plate (tensile strength of about 185 Mpa), or the like, which preferably has a thickness of 50 to 1000 $\mu$m. Particularly, a resin plate biaxially oriented to decrease creep is more preferable.

Next, a development device using the development blade of the present invention will be described with reference to the drawings.

FIG. 1 is a schematic drawing showing an example of the construction of a development device. In FIG. 1, the development container 2 contains the toner 6, and the development sleeve 3 as a toner holding member provided opposite to the photosensitive member 1 serving as an image holding member which is rotated in the direction of an arrow a so that an electrostatic latent image on the photosensitive member 1 is developed to form a visible toner image. In FIG. 1, the development sleeve 3 is rotatably provided opposite to the photosensitive member 1 so that substantially a half right periphery of the development sleeve 3 is projected into the development container 2, and substantially a half left periphery thereof is exposed to the outside. A small gap is formed between the development sleeve 3 and the photosensitive member 1. The development sleeve 3 is rotated in the direction of arrow L opposite to the rotation direction a of the photosensitive member 1.

In the development container 2, the development blade 4 of the present invention is provided above the development sleeve 3, and the elastic roller 5 is provided at a position upstream of the development blade 4 in the rotation direction of the development sleeve 3.

The development blade 4 is provided to be inclined downward to the upstream side in the rotation direction of the development sleeve and brought into contact with the upper peripheral surface of the development sleeve in opposition to the rotation direction. The elastic roller 5 is rotatably supported and brought into contact with a portion of the development sleeve 3 opposite to the photosensitive member 1.

In the development device having the above construction, the elastic roller 5 is rotated in the direction of an arrow c to hold the toner 6 and supply the toner 6 to the vicinity of the development sleeve 3. The toner 6 on the elastic roller 5 adheres to the development sleeve 3 due to friction between the elastic roller 5 and the development sleeve 3 in the contact portion (nip portion) between the development sleeve 3 and the elastic roller 5.

Then, the toner which adheres to the development sleeve 3 enters the contact portion between the development blade 4 and the development sleeve 3 with rotation of the development sleeve 3, and is sufficiently triboelectrically charged during passage through the contact portion between the surface of the development sleeve 3 and the development blade 4.

The toner 6 charged as described above is separated from the contact portion between the development blade 4 and the development sleeve 3 to form a thin layer of the toner 6 on the development sleeve 3, and then transferred to a development region provided opposite to the photosensitive member 1 with a small gap therebetween. In the development region, for example, an alternate voltage in which an alternating current is superposed on a direct current is applied as a development bias between the development sleeve 3 and the photosensitive member 1 to transfer the toner 6 on the development sleeve 3 to the photosensitive member 1 corresponding to the electrostatic latent image. As a result, the toner 6 adheres to the electrostatic latent image to form a visible toner image.

The toner 6 not consumed in development in the development region and remaining on the development sleeve 3 reaches the contact portion between the elastic roller 5 and the development sleeve 3 with rotation of the development sleeve 3, and is separated from the development sleeve 3. At the same time, a new toner 6 is supplied on the development sleeve 3 with rotation of the elastic roller 5, and again transferred to the contact portion between the development sleeve 3 and the development blade 4.

The toner 6 separated from the development sleeve 3 is mostly transferred into the toner 6 in the development container 2 with rotation of the development roller 5, and mixed therewith to disperse electric charge of the separated toner 6.

As the toner, a known magnetic toner, non-magnetic toner, or the like is used, which preferably has an average particle diameter of 3 to 15 m.

Figure 3:
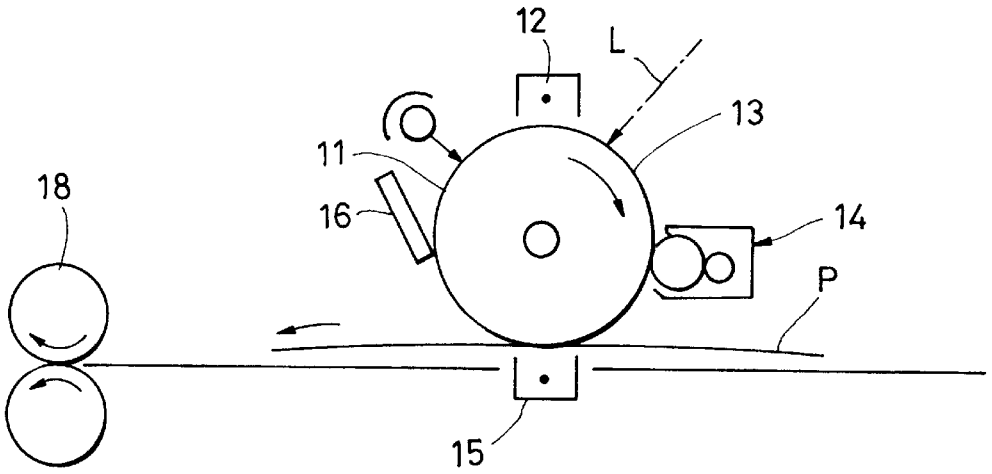
FIG. 3 is a drawing illustrating an example of the construction of an electrophotographic apparatus to which a development device of the present invention is applied.

FIG. 3 shows an example of electrophotographic apparatus suitable for application of the development device of the present invention. In FIG. 3, a photosensitive member 11 to be charged is a drum-shaped electrophotographic photosensitive member comprising a conductive substrate made of aluminum or the like, and a photosensitive layer formed as a basic constitutive layer on the outer curved surface of the conductive substrate. The photosensitive member 11 is rotated around the support shaft at a predetermined peripheral speed in the clockwise direction shown by an arrow in FIG. 3.

A charging member 12 comprises a corona discharge device brought into contact with the surface of the photosensitive member 11 to uniformly primarily charge the surface of the photosensitive member 11 to predetermined polarity and potential.

The surface of the photosensitive member 11 which is uniformly charged by the charging member 12 is then exposed to light (laser beam scanning exposure, slit exposure of an original image, or the like) according to intended image information by exposure means L to form an electrostatic latent image 13 on the periphery of the photosensitive member 11 according to the intended image information.

The latent image is visualized by a development device 14 to form a toner image.

The toner image is transferred, by transfer means 15, to the surface of a transfer material P, which is carried from paper feed means (not shown) to a transfer region between the photosensitive member 11 and the transfer means 15 synchronously with rotation of the photosensitive member 11 with appropriate timing. In this example, the transfer means 15 comprises a corona discharge device for charging the transfer paper P to the polarity opposite to the toner from the rear side thereof to transfer the toner image on the surface of the photosensitive member 11 to the surface side of the transfer material P. In color LBP (Laser Beam Printer) for outputting a color image by using toners of four colors, in order to develop each of color images of four colors to form a visible image, the toner is transferred onto an intermediate transfer material such as a roller, a belt, or the like, and a toner image is then transferred to the surface side of the transfer material P.

After contaminants which adhere to the surface of the photosensitive member 11, e.g., the toner remaining after transfer, are removed by cleaning means 16 to clean the photosensitive member 11, the photosensitive member 11 is again used for forming an image.

As the developer amount regulating member, besides the blade shown in FIG. 1, a roll, a belt, and the like may be used.

A plurality of components of an electrophotographic apparatus, such as the photosensitive member, the charging member, the development device, and the cleaning means, can be integrally combined in a process cartridge. The process cartridge can be detachably mounted to the body of the apparatus. For example, the photosensitive member, the development device, and if required, the charging member and the cleaning means are integrally combined in a process cartridge so that the process cartridge can be detachably mounted to the body of the apparatus by using guide means such as a rail or the like.

Examples of electrophotographic apparatus which can use the development device include a copying machine, a laser beam printer, a LED printer, an electrophotographic applied device such as an electrophotographic plate making system, and the like.

EXAMPLES

The present invention will be described below with reference to examples.

Example 1

The development blade 4 shown in FIG. 2 was produced as follows. The support layer comprised a phosphor bronze plate (the thickness, 0.12 mm; the width, 22 mm; and the length of the side on which a charge applying layer is coated, 210 mm) having spring elasticity. This support layer was previously provided on a mold, and a polyamide elastomer (produced by Daicel Hüls Ltd., Daiamide PAEE30-S3) containing an oligomer component extracted with methanol was used as the charge applying layer. Extraction of oligomers was carried out by placing pellets of a polyamide elastomer in a reactor at a methanol/polyamide elastomer weight ratio of 1:1, extracting oligomers at room temperature for 5 hours, and then drying the pellets by using an evaporator at 60° C. or less. After drying at 70° C. for 6 hours, the pellets were molded directly by injection compression molding using the mold on which the support layer was provided, at a melting temperature of 250° C. and a mold temperature of 40° C. to produce the development blade having the charge applying layer having a thickness of 1 mm, a width of 5 mm, and a length of 210 mm.

The amount of the oligomers contained in the development blade produced as described above, particularly the amount of a nylon 12 dimer as a main component of bloom, was analyzed by gel permeation chromatography (GPC) to measure the amount of dimer. In GPC analysis, the charge applying layer (polyamide elastomer) was separated from the support layer of the blade after molding, cut into 2 mm squares, and then extracted with THF at room temperature for 15 hours, and at 55° C. for 3 hours, and GPC analysis was performed by using THF for elution under conditions including a flow rate of 1 ml/min and an injection amount of 100 μl. The apparatus used was HPLC8120 produced by Toyo Soda Co., Ltd., and three columns of SHODEX, KF801, KF802, and KF803 were combined. The amount of dimer was determined from a calibration curve formed by using ω-laurolactam as a standard sample.

The blooming property was evaluated by observing the blade surface by an electron microscope after the development blade was allowed to stand for 30 days in a constant-temperature bath at 23° C. and 50% RH as conditions of normal temperature and normal humidity, or 450° C. and humidity of 95% RH as conditions of high temperature and high humidity. Evaluation was made on the basis of the following criteria: o means no blooming; Δ, slight blooming; and x, blooming to cover the surface. The results are shown in Table 1.

A development sleeve comprising an aluminum tube which was blasted to a ten-point average roughness Rz=2.5 μm, and development sleeves which were allowed to stand in a constant-temperature bath at 23° C. and 50% RH and 45° C. and 95% RH for 30 days were mounted to the development device so that the contact pressure was 18 g/cm. The development container was provided with a foamed urethane sponge roller having the functions to coat toner on the development sleeve, remove the toner remaining after development, and return again the toner to the development container. Non-magnetic toner was contained in the development container, and a solid image self-forming test was carried out by using a laser beam printer (Lasershot; produced by Canon Inc.) at room temperature to evaluate the presence of the toner on the basis of the following criteria: o represents no fogging; Δ, slight fogging; and x, significant fogging. The results are shown in Table 1.

Example 2

A development blade was produced by the same method as Example 1 except that the time of extraction of oligomers was 15 hours, and evaluated by the same method as Example 1. The results are shown in Table 1.

Example 3

A development blade was produced by the same method as Example 1 except that the time of extraction of oligomers was 25 hours, and evaluated by the same method as Example 1. The results are shown in Table 1.

Example 4

A development blade was produced by the same method as Example 1 except that the methanol/polyamide elastomer weight ratio was 3:1, and the conditions of extraction of oligomers included room temperature and a time of 5 hours, and evaluated by the same method as Example 1. The results are shown in Table 1.

Example 5

A development blade was produced by the same method as Example 4 except that the time of extraction of oligomers was 15 hours, and evaluated by the same method as Example 1. The results are shown in Table 1.

Example 6

A development blade was produced by the same method as Example 4 except that the time of extraction of oligomers was 25 hours, and evaluated by the same method as Example 1. The results are shown in Table 1.

Example 7

A development blade was produced by the same method as Example 1 except that the methanol/polyamide elastomer weight ratio was 5:1, and the conditions of extraction of oligomers included room temperature and a time of 5 hours, and evaluated by the same method as Example 1. The results are shown in Table 1.

Example 8

A development blade was produced by the same method as Example 7 except that the time of extraction of oligomers was 15 hours, and evaluated by the same method as Example 1. The results are shown in Table 1.

Example 9

A development blade was produced by the same method as Example 7 except that the time of extraction of oligomers was 25 hours, and evaluated by the same method as Example 1. The results are shown in Table 1.

Comparative Example 1

A development blade was produced by the same method as Example 1 except that the methanol/polyamide elastomer weight ratio was 1:1, and the conditions of extraction of oligomers included room temperature and a time of 3 hours, and evaluated by the same method as Example 1. The results are shown in Table 1.

Comparative Example 2

A development blade was produced by the same method as Example 1 except that extraction of oligomers was not conducted, and evaluated by the same method as Example 1. The results are shown in Table 1.

TABLE 1

| | Extraction of Dimer | | | | | | | |
|---|---|---|---|---|---|---|---|---|
| | Extraction Conditions | | | Residue | Image Formation | | | |
| | Temperature (° C.) | MeOH/PAE (weight ratio) | Time (hrs) | after extraction (ppm) | 23° C., 50% RH | | 45° C., 50% RH | |
| | | | | | Blooming | Fogging | Blooming | Fogging |
| Example 1 | 25 | 1 | 5 | 1800 | ○ | ○ | Δ | Δ |
| Example 2 | 25 | 1 | 15 | 1100 | ○ | ○ | Δ | Δ |
| Example 3 | 25 | 1 | 25 | 800 | ○ | ○ | ○ | ○ |
| Example 4 | 25 | 3 | 5 | 1500 | ○ | ○ | Δ | Δ |
| Example 5 | 25 | 3 | 15 | 650 | ○ | ○ | ○ | ○ |
| Example 6 | 25 | 3 | 25 | 500 | ○ | ○ | ○ | ○ |
| Example 7 | 25 | 5 | 5 | 1200 | ○ | ○ | Δ | Δ |
| Example 8 | 25 | 5 | 15 | 550 | ○ | ○ | ○ | ○ |
| Example 9 | 25 | 5 | 25 | 300 | ○ | ○ | ○ | ○ |
| Comp. Example 1 | 25 | 1 | 3 | 2500 | Δ | Δ | x | x |
| Comp. Example 2 | | Untreated | | 3500 | x | x | x | x |

Blooming ○: No
Fogging ○: No
Δ: Slight
Δ: Slight
x: Significant
x: Significant

As in Examples 1 to 9, with a dimer amount of less than 2500 ppm, no blooming occurred on the blade surface, and no fogging occurred in an image even when the blade was allowed to stand in an environment of normal temperature and normal humidity. In allowing the development blade to stand in an environment of high temperature and high humidity, as in Examples 3, 5, 6, 8, and 9, with a dimer amount of less than 1000 ppm, no blooming occurred, and good images were obtained. However, as in Examples 1, 2, 4 and 7, with a dimer amount of 1000 to 2500 ppm, slight blooming occurred, and thus images were slightly fogged. In Comparative Example 1, with a dimer amount of less than 2500 ppm, blooming occurred, and slight fogging occurred in an image even when the blade was allowed to stand in an environment of normal temperature and normal humidity. In Comparative Example 2, with a dimer amount of 3500 ppm, significant blooming occurred, and an image was fogged.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developer amount regulating member comprises at least a portion for regulating the amount of a developer, said regulating portion comprising a polyamide elastomer, wherein a content of a polyamide dimer in the polyamide elastomer is less than 2500 ppm.

2. A developer amount regulating member according to claim 1, wherein the content of the polyamide dimer in the polyamide elastomer is less than 1000 ppm.

3. A developer amount regulating member according to claim 1, wherein the polyamide elastomer comprises a block copolymer of a polyamide and a polyether.

4. A developer amount regulating member according to claim 3, wherein the polyamide is nylon 12.

5. A developer amount regulating member according to claim 1, wherein the developer amount regulating member comprises a blade shape comprising a support and a portion for regulating an amount of a developer.

6. A method of producing a developer amount regulating member comprises at least a portion for regulating an amount of a developer, said regulating portion comprising a polyamide elastomer, the method comprising:

extracting a polyamide dimer contained in the polyamide elastomer by solvent treatment; and molding the polyamide elastomer having the polyamide dimer content decreased to less than 2500 ppm.

7. A development device comprises at least:

a development container for containing a developer:

a developer holding member comprising a rotating member having a cylindrical surface for holding the developer contained in the development container; and a developer amount regulating member, in contact with the developer holding member, for regulating the amount of the developer held by the cylindrical surface and applying a charge to the developer;

wherein the developer amount regulating member comprises at least a portion for regulating the amount of a developer, said regulating portion comprising a polyamide elastomer, wherein a content of a polyamide dimer in the polyamide elastomer is less than 2500 ppm.

8. A development device according to claim 7, wherein the content of the polyamide dimer in the polyamide elastomer is less than 1000 ppm.

9. A development device according to claim 8, wherein the polyamide elastomer comprises a block copolymer of a polyamide and a polyether.

10. A development device according to claim 9, wherein the developer amount regulating member comprises a blade shape comprising a support and a portion for regulating the amount of a developer.

11. A process cartridge comprising at least a photosensitive member and a development device, both of which are integrally combined so that the process cartridge can be detachably mounted to an apparatus, wherein the development device is a development device according to claim 7, 8, 9 or 10.

* * * * *

UNITED STATES PATENT AND TRADEMARK OFFICE

CERTIFICATE OF CORRECTION

PATENT NO. : 6,094,555
DATED : July 25, 2000
INVENTOR(S) : Hisao Katoh, et al.

It is certified that error appears in the above-identified patent and that said Letters Patent is hereby corrected as shown below:

Column 4,
Line 52, "L" should read -- b --.

Column 9,
Table 1, replace Table 1 with the attached Table 1.

UNITED STATES PATENT AND TRADEMARK OFFICE

CERTIFICATE OF CORRECTION

PATENT NO. : 6,094,555
DATED : July 25, 2000
INVENTOR(S) : Hisao Katoh, et al.

Table 1

| | Extraction of Dimer | | | | Image Formation | | | |
|---|---|---|---|---|---|---|---|---|
| | Extraction Conditions | | | Residue after extraction (ppm) | 23°C, 50% RH | | 45°C, 50% RH | |
| | Temperature (°C) | MeOH/PAE (weight ratio) | Time (hrs) | | Blooming | Fogging | Blooming | Fogging |
| Example 1 | 25 | 1 | 5 | 1800 | O | O | Δ | Δ |
| Example 2 | 25 | 1 | 15 | 1100 | O | O | Δ | Δ |
| Example 3 | 25 | 1 | 25 | 800 | O | O | O | O |
| Example 4 | 25 | 3 | 5 | 1500 | O | O | Δ | Δ |
| Example 5 | 25 | 3 | 15 | 650 | O | O | O | O |
| Example 6 | 25 | 3 | 25 | 500 | O | O | O | O |
| Example 7 | 25 | 5 | 5 | 1200 | O | O | Δ | Δ |
| Example 8 | 25 | 5 | 15 | 550 | O | O | O | O |
| Example 9 | 25 | 5 | 25 | 300 | O | O | O | O |
| Comp. Example 1 | 25 | 1 | 3 | 2500 | Δ | Δ | x | x |
| Comp. Example 2 | Untreated | | | 3500 | x | x | x | x |

Blooming O: No Δ: Slight x: Significant

Fogging O: No Δ: Slight x: Significant

Signed and Sealed this

Thirtieth Day of October, 2001

*Attest:*

Nicholas P. Godici

*Attesting Officer*

NICHOLAS P. GODICI
*Acting Director of the United States Patent and Trademark Office*